US010075781B2

(12) United States Patent
Akino

(10) Patent No.: US 10,075,781 B2
(45) Date of Patent: Sep. 11, 2018

(54) MICROPHONE

(71) Applicant: Hiroshi Akino, Kanagawa (JP)

(72) Inventor: Hiroshi Akino, Kanagawa (JP)

(73) Assignee: Audio-Technica Corporation, Tokyo (JP)

( * ) Notice: Subject to any disclaimer, the term of this patent is extended or adjusted under 35 U.S.C. 154(b) by 15 days.

(21) Appl. No.: 15/338,815

(22) Filed: Oct. 31, 2016

(65) Prior Publication Data

US 2017/0171654 A1 Jun. 15, 2017

(30) Foreign Application Priority Data

Dec. 14, 2015 (JP) ..... 2015-243610

(51) Int. Cl.
*H04R 31/00* (2006.01)
*H04R 1/08* (2006.01)
*H04R 1/02* (2006.01)

(52) U.S. Cl.
CPC ..... *H04R 1/083* (2013.01); *H04R 31/006* (2013.01); *H04R 1/021* (2013.01); *H04R 2410/03* (2013.01)

(58) Field of Classification Search
None
See application file for complete search history.

(56) References Cited

U.S. PATENT DOCUMENTS 2,622,836 A * 12/1952 Lee ..... F16F 13/08 267/141.6
2,848,561 A * 8/1958 Gorike ..... H04R 1/222 181/158
3,467,572 A * 9/1969 Ahramjian ..... B32B 27/00 181/290
3,585,317 A * 6/1971 Dvorsky ..... H04R 1/38 381/338
4,132,825 A * 1/1979 Hahn ..... B32B 7/02 156/307.3
5,087,491 A * 2/1992 Barrett ..... B32B 7/02 248/560
7,606,385 B2 * 10/2009 Akino ..... H04R 1/083 381/355
8,789,820 B2 * 7/2014 Yu ..... F16F 1/3732 267/141

FOREIGN PATENT DOCUMENTS

JP 4411112 B2 2/2010

* cited by examiner

*Primary Examiner* — Matthew Eason
*Assistant Examiner* — Taunya McCarty
(74) *Attorney, Agent, or Firm* — W&C IP

(57) ABSTRACT

A microphone is provided that prevents or reduces generation of noises caused by vibration from a grip body. A microphone includes a grip body having a shape of a cylinder, a head case attached to the grip body, a microphone unit disposed inside the head case, an internal cylinder to which the microphone unit is attached, and an elastic member configured to undergo shear deformation in the longitudinal direction of the grip body. The internal cylinder is disposed inside the grip body with the elastic member.

6 Claims, 10 Drawing Sheets

MICROPHONE

TECHNICAL FIELD

The present invention relates to a microphone.

BACKGROUND ART

Some microphones are handheld microphones used for vocal performance. The handheld microphone includes, for example, a grip body having a shape of a cylinder and a microphone unit (hereinafter referred to as "unit") supported at one end of the grip body.

When used, the handheld microphone is gripped by a user at the grip body serving as a grip. When the handheld microphone is used by the user, vibration can be caused by shaking of the hands of the user or by dropping the microphone from the hands of the user. Such vibration is transmitted from the grip body to the unit. As a result, the handheld microphone can generate undesired noises.

With respect to techniques for preventing the transmission of vibration to the unit, techniques have been proposed to attach the unit to an internal cylinder supported inside the grip body that is isolated from vibration by shock mounts (for example, refer to Japanese Patent No. 4411112).

The microphone disclosed in Japanese Patent No. 4411112 includes a grip body having a shape of a cylinder, a cavity sleeve (internal cylinder) having a shape of a cylinder, a unit, shock mounts, and a pressing ring having a shape that is substantially cylindrical. The internal cylinder is disposed inside the grip body. The internal cylinder has a flange portion. The flange portion is disposed on the outer circumferential surface of the internal cylinder. The unit is attached to the front end portion of the internal cylinder.

The shock mounts are disposed between the grip body and the internal cylinder and prevent transmission of vibration from the grip body to the internal cylinder. The shock mounts are composed of elastic rubber. The shock mounts include a front shock mount and a rear shock mount.

The front shock mount has a shape that is substantially cylindrical. The front shock mount is attached to the outer circumferential surface of the front portion of the internal cylinder. The rear end surface of the front shock mount is in contact with the flange portion of the internal cylinder. The pressing ring is disposed so as to cover the outer circumferential surface of the front shock mount. The front end of the pressing ring is turned inward. The inner surface of the turned pressing ring is in contact with the front end surface of the front shock mount.

The rear shock mount has a shape of a hollow cylinder with a closed end. The rear shock mount is attached to the rear end of the internal cylinder.

As described above, the internal cylinder to which the unit is attached is supported by the two shock mounts attached to the front portion and the rear end of the internal cylinder. The internal cylinder is isolated from vibration by the two shock mounts. That is, vibration from the grip body to the internal cylinder is damped by the elasticity of the shock mounts.

SUMMARY OF INVENTION

Technical Problem

When the contact area between the shock mounts and the internal cylinder is large, the vibration from the grip body is transmitted to the internal cylinder via the shock mounts as longitudinal waves. In general, the front shock mount is attached near the unit. Thus, the front shock mount transmits vibration to the unit more readily than the rear shock mount.

As described above, the front shock mount has a shape that is substantially cylindrical. The inner circumferential surface of the front shock mount is in tight contact with the outer circumferential surface of the internal cylinder over a relatively large area. When a force in the front-back direction is applied to the front shock mount, the front shock mount is compressed in the front-rear direction. Thus, the degree of contact between the inner circumferential surface of the front shock mount and the outer circumferential surface of the internal cylinder increases. As a result, the vibration from the grip body is transmitted to the unit via the front shock mount and the internal cylinder as longitudinal waves. The microphone to which the vibration is transmitted generates noises.

An object of the present invention is to solve the problems described above and to prevent or reduce generation of noises caused by vibration from the grip body.

Solution to Problem

The microphone according to the present invention includes a grip body having a shape of a cylinder, a head case attached to the grip body, a microphone unit disposed inside the head case, an internal cylinder to which the microphone unit is attached, and an elastic member configured to undergo shear deformation in the longitudinal direction of the grip body. The internal cylinder is disposed inside the grip body with the elastic member.

The microphone according to the present invention can prevent or reduce generation of noises caused by vibration from the grip body.

DESCRIPTION OF EMBODIMENTS

Microphone

Embodiments of a microphone according to the present invention will now be described with reference to the attached drawings.

Configuration of Microphone

Figure 1:
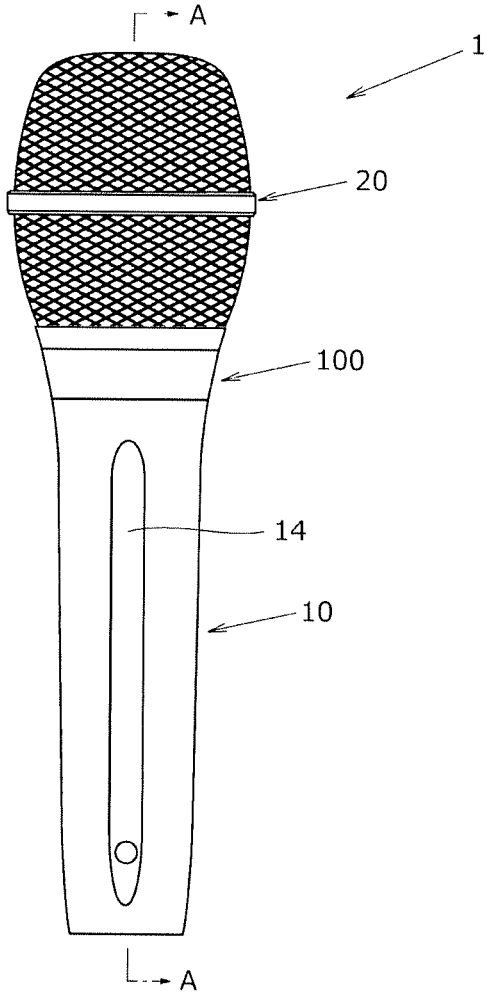
FIG. 1 is a front view illustrating an embodiment of a microphone according to the present invention.

FIG. 1 is a front view illustrating an embodiment of a microphone according to the present invention.

A microphone 1 collects acoustic waves from a sound source (not shown). The microphone 1 is a handheld microphone.

Figure 2:
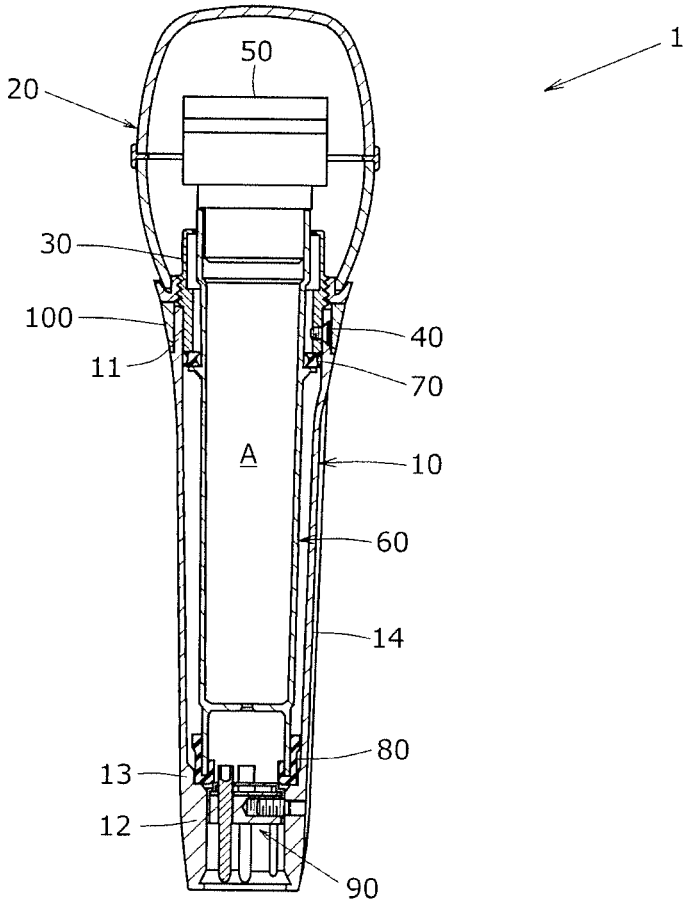
FIG. 2 is a cross-sectional view of the microphone taken along line A-A of FIG. 1.

FIG. 2 is a cross-sectional view of the microphone 1 taken along line A-A of FIG. 1.

Figure 3:
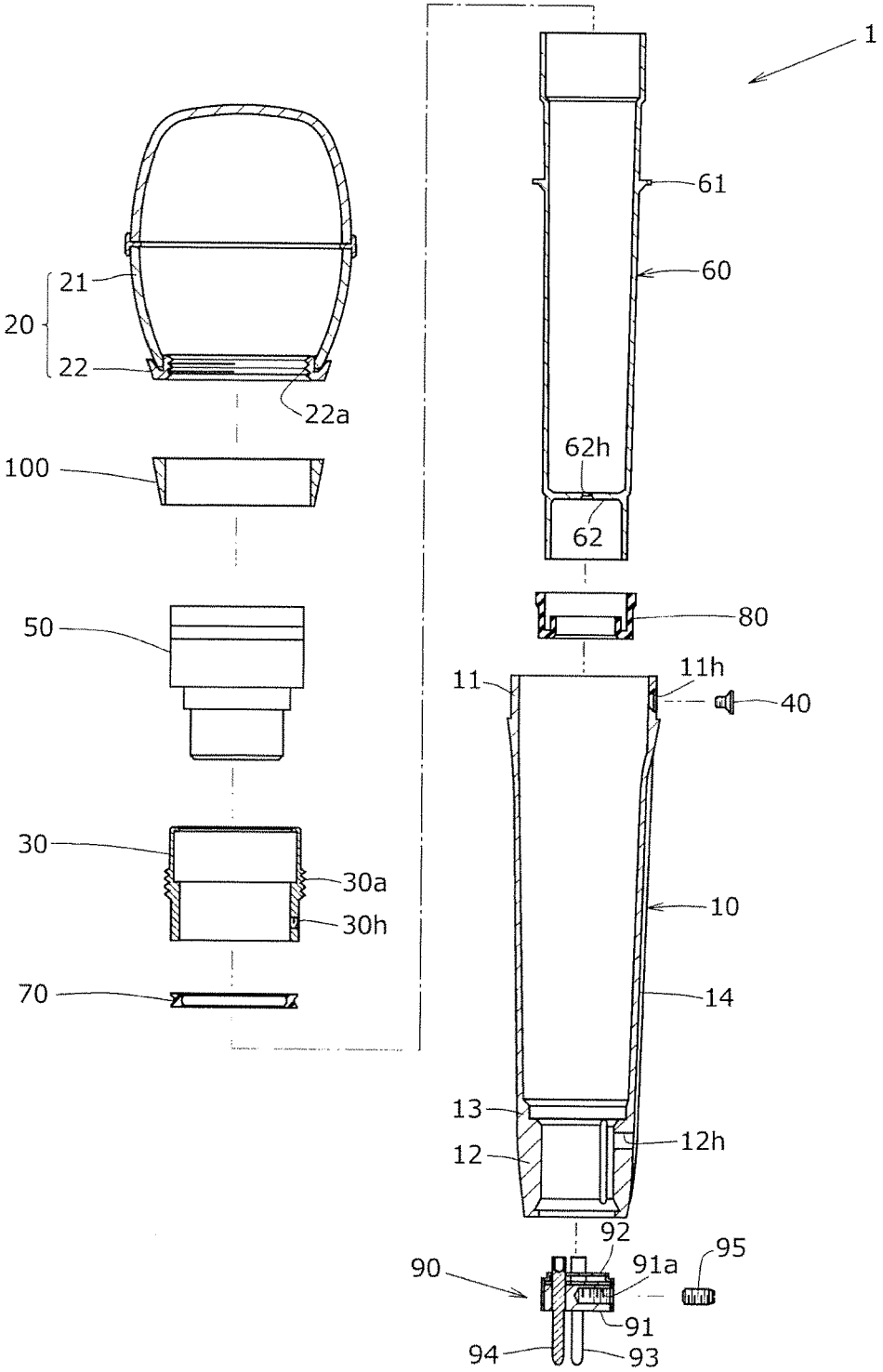
FIG. 3 is an exploded cross-sectional view of the microphone in FIG. 2.

FIG. 3 is an exploded cross-sectional view of the microphone 1.

The microphone 1 includes a grip body 10, a head case 20, a head-case attaching member 30, a screw 40, a microphone unit (hereinafter referred to as "unit") 50, an internal cylinder 60, a first elastic member 70, a second elastic member 80, an output connector 90, and a name ring 100.

In the description below, the direction to which the microphone 1 is directed during sound collection (the upper side of FIG. 2) is referred to as "front."

The grip body 10 functions as a grip of the microphone 1. The grip body 10 is composed of metal, such as brass, for example. The grip body 10 is manufactured by die-casting, for example. The grip body 10 has a shape of a cylinder. The outer diameter of the grip body 10 gradually increases from the rear portion (the lower portion in the grip body 10 of FIG. 2) of the grip body 10 to the front portion (the upper portion in the grip body 10 of FIG. 2) of the grip body 10. The grip body 10 includes a fixing portion 11, a connector accommodating portion 12, a fitting portion 13, and a side-cut portion 14.

The fixing portion 11 is disposed in the front portion of the grip body 10. The fixing portion 11 fixes the head-case attaching member 30. The outer and inner diameters of the fixing portion 11 are constant. The fixing portion 11 has a screw insertion hole 11*h*. The screw insertion hole 11*h* is disposed in the circumferential wall of the fixing portion 11. The screw 40 is inserted into the screw insertion hole 11*h*.

The connector accommodating portion 12 is disposed in the rear portion of the grip body 10. The connector accommodating portion 12 accommodates the output connector 90. The inner diameter of the connector accommodating portion 12 is smaller than the inner diameters of other portions of the grip body 10. The connector accommodating portion 12 has a tool insertion hole 12*h* described below. The tool insertion hole 12*h* is disposed in the circumferential wall of the connector accommodating portion 12.

The fitting portion 13 is disposed in a portion of the grip body 10 adjacent to the front end of the connector accommodating portion 12. The fitting portion 13 fits with the second elastic member 80. The inner diameter of the fitting portion 13 is larger than the inner diameter of the connector accommodating portion 12.

The side-cut portion 14 is disposed on the outer circumferential surface of the grip body 10. The side-cut portion 14 enhances the fitting when a user grips the grip body 10 of the microphone 1. The side-cut portion 14 is a flat region formed along the front-back direction.

The head case 20 accommodates and protects the unit 50. The head case 20 includes a case portion 21 and a fixing portion 22. The case portion 21 protects the unit 50. The case portion 21 has a three-layer structure consisting of a steel outer grill, a metal mesh (not shown), and a urethane foam (not shown), for example. The case portion 21 has a shape of a barrel with an open rear end. The fixing portion 22 fixes the case portion 21 to the head-case attaching member 30. The fixing portion 22 has a shape of a ring. The fixing portion 22 is attached to the rear end (open end) of the case portion 21. The fixing portion 22 has an internally threaded portion 22*a*. The internally threaded portion 22*a* is disposed on the inner circumferential surface of the fixing portion 22.

The head-case attaching member 30 fixes the head case 20 to the grip body 10. The head-case attaching member 30 is composed of metal, such as brass, for example. The head-case attaching member 30 has a shape of a substantial cylinder. The head-case attaching member 30 has an externally threaded portion 30*a* and an internally threaded hole 30*h*. The externally threaded portion 30*a* is disposed on the outer circumferential surface of the central portion of the head-case attaching member 30 in the front-back direction. The internally threaded hole 30*h* is disposed in the circumferential wall of the rear half of the head-case attaching member 30. The screw 40 is screwed into the internally threaded hole 30*h*.

The screw 40 fixes the head-case attaching member 30 to the grip body 10. The screw 40 is a flat head screw, for example.

The unit 50 collects acoustic waves from the sound source. The unit 50 is a unidirectional dynamic microphone unit, for example.

The directivity of the unit 50 is not limited to unidirectivity. The type of the unit 50 is not limited to a dynamic type. Rather, unit 50 can be of any desired type for the application.

The internal cylinder 60 supports the unit 50 and defines an air chamber A described below inside the internal cylinder 60. The internal cylinder 60 is composed of metal, such as brass, for example. The internal cylinder 60 is manufactured by die-casting, for example. The internal cylinder 60 has a shape of a cylinder. The internal cylinder 60 has a flange portion 61 and a partition 62. The flange portion 61 is disposed on the outer circumferential surface of the front half of the internal cylinder 60 and protrudes along the entire circumference from the outer circumferential surface of the internal cylinder 60 in radial direction. The flange portion 61 will be described below. The partition 62 is disposed on the inner circumferential surface of the rear half of the internal cylinder 60. The partition 62 separates the internal space of the internal cylinder 60 into front and rear sections. The partition 62 has an insertion hole 62*h*. A cable (not shown) configured to connect electrically the unit 50 and the output connector 90 is to be inserted through the insertion hole 62*h*.

The first elastic member 70 prevents transmission of vibration from the grip body 10 to the internal cylinder 60 supporting the unit 50. The first elastic member 70 is one example of a suitable elastic member of the microphone according to the present invention. The first elastic member 70 is composed of elastic synthetic resin, such as rubber, for example. The first elastic member 70 has a shape of a ring.

Figure 4:
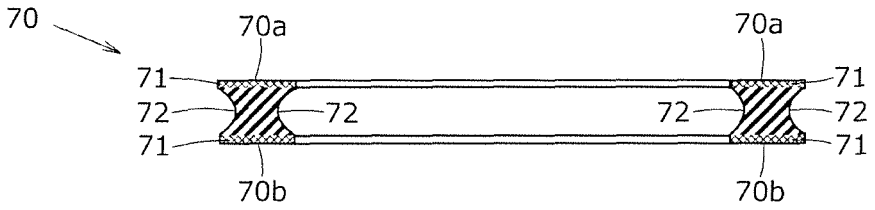
FIG. 4 is an enlarged cross-sectional view of a first elastic member of the microphone in FIG. 2.

FIG. 4 is an enlarged cross-sectional view of the first elastic member 70.

The first elastic member 70 has skin layers 71 and depressions 72. The skin layers 71 are a front end face 70*a* (top surface) of the first elastic member 70 and a rear end face 70*b* (bottom surface) of the first elastic member 70 which are formed by thermal curing of the surfaces of the first elastic member 70. The modulus of elasticity of the skin layers 71 is larger than the modulus of elasticity of a portion other than the skin layers 71 (hereinafter referred to as "elastic portion") of the first elastic member 70.

The skin layers may be a component separate from the first elastic member. That is, the skin layers may be attached to the front end face and the rear end face of the first elastic member. In such a case, the modulus of elasticity of the skin layers is larger than the modulus of elasticity of the first elastic member. The skin layer should be attached to at least one of the front end face and the rear end face of the first elastic member.

The outer diameter of the skin layers 71 is larger than the outer diameter of the flange portion 61 of the internal cylinder 60. The outer diameter of the skin layers 71 is substantially identical to the inner diameter of the fixing portion 11 of the grip body 10.

The elastic portion has a shape of an hourglass narrow in the middle in the front-back direction (the vertical direction in FIG. 4) in a cross-sectional view. That is, the outer diameter of the elastic portion gradually decreases along the front-back direction, from the two skin layers 71 toward the central area of the elastic portion. The inner diameter of the elastic portion of the first elastic member 70 gradually increases along the front-back direction (the vertical direction in FIG. 4), from the two skin layers 71 toward the central area of the elastic portion. In other words, the depressions 72 extend around the entire outer circumferential surface and the entire inner circumferential surface of the first elastic member 70.

The depression 72 should extend around at least one of the entire outer circumferential surface or the entire inner circumferential surface of the first elastic member 70.

The second elastic member 80 prevents transmission of vibration from the grip body 10 to the internal cylinder 60 holding the unit 50. The second elastic member 80 is composed of elastic synthetic resin, such as rubber, for example. As shown in FIGS. 2 and 3, the second elastic member 80 has a shape of a double cylinder having a rear end bent into a U-shape in cross-section.

The output connector 90 is, for example, an output connector conforming to JEITA Standard RC-5236 "Circular Connectors, Latch Lock Type for Audio Equipment." As shown in FIG. 3, the output connector 90 includes a base 91 having a shape of a column, a shield cover 92 having a shape of a hollow cylinder with a closed end, a first pin for ground (not shown), a second pin 93 for hot signals, a third pin 94 for cold signals, and an external screw 95.

The base 91 has an internally threaded hole 91*a* extending from the outer circumferential surface of the base 91 in the radial direction of the base 91. The external screw 95 is screwed into the internally threaded hole 91*a*. The shield cover 92 is disposed so as to cover the base 91. The shield cover 92 covers the front surface of the base 91 and the circumferential surface of the base 91 other than the internally threaded hole 91*a*. The first pin, the second pin 93, and the third pin 94 penetrate the base 91 and the shield cover 92 in the front-back direction. The outer diameter of the head of the external screw 95 is smaller than the outer diameter of the threaded portion of the external screw 95 and the inner diameter of the tool insertion hole 12*h* of the grip body 10. The external screw 95 has a stepped shoulder portion disposed between the threaded portion and the head of the external screw 95.

The name ring 100 covers the fixing portion 11 of the grip body 10 and the screw 40 to improve the external appearance of the microphone 1. The name ring 100 is composed of metal, for example, and has a shape that is substantially cylindrical.

Among the components of the microphone 1, the head-case attaching member 30, the unit 50, the internal cylinder 60, the first elastic member 70, and the second elastic member 80 constitute a first assembly. The first assembly, the grip body 10, and the output connector 90 constitute a second assembly.

Method of Manufacturing Microphone

A method of assembling (manufacturing) the microphone 1 will now be described.

Figure 5:
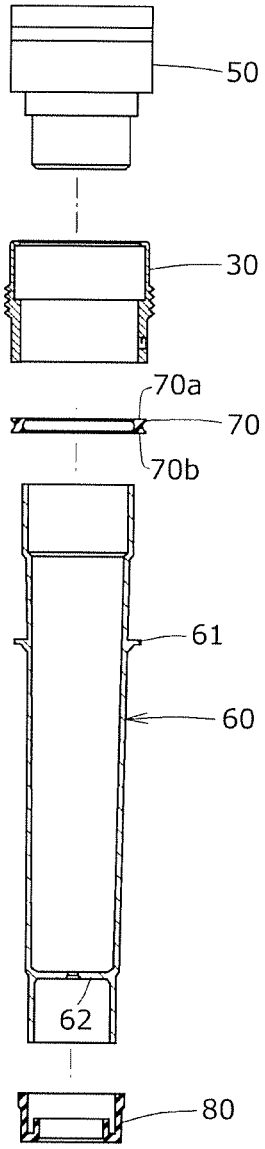
FIG. 5 is an exploded cross-sectional view of a first assembly of the microphone in FIG. 2.

FIG. 5 is an exploded cross-sectional view of a first assembly of the microphone 1.

Figure 6:
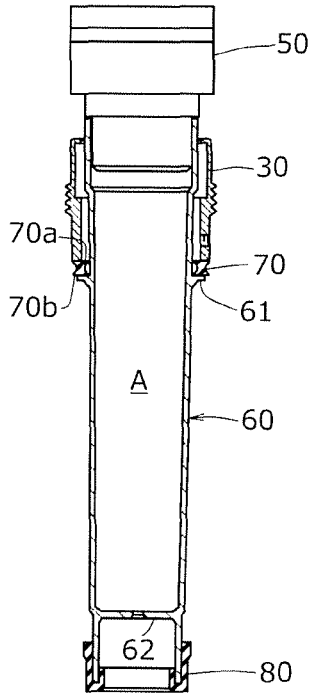
FIG. 6 is a cross-sectional view of the first assembly of the microphone in FIG. 5.

FIG. 6 is a cross-sectional view of the first assembly of the microphone 1.

Figure 7:
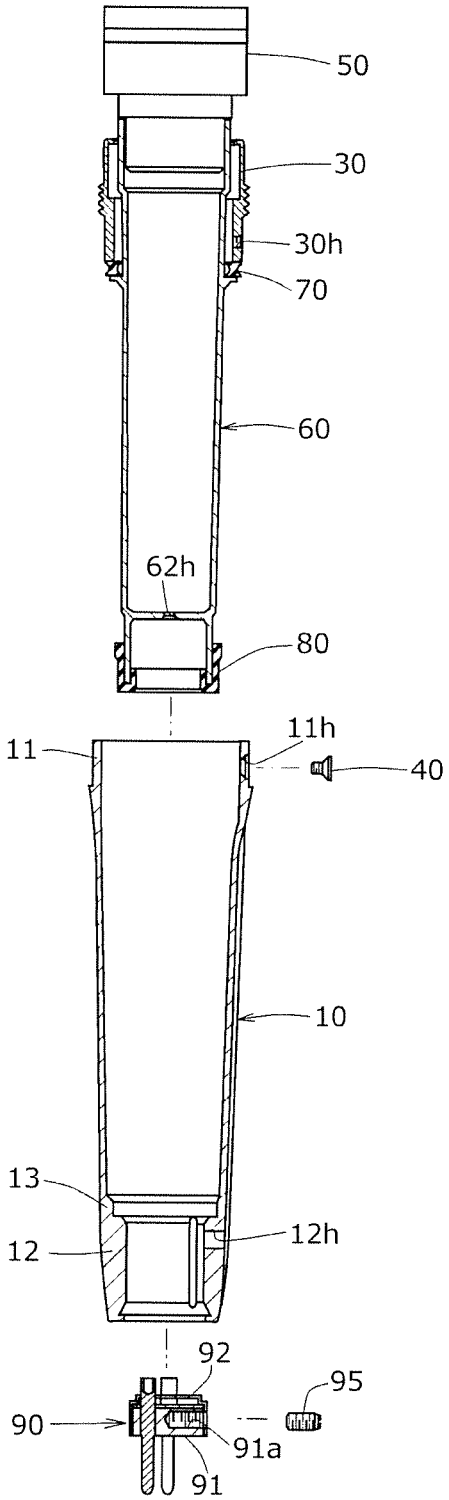
FIG. 7 is an exploded cross-sectional view of a second assembly of the microphone in FIG. 2.

FIG. 7 is an exploded cross-sectional view of a second assembly of the microphone 1.

Figure 8:
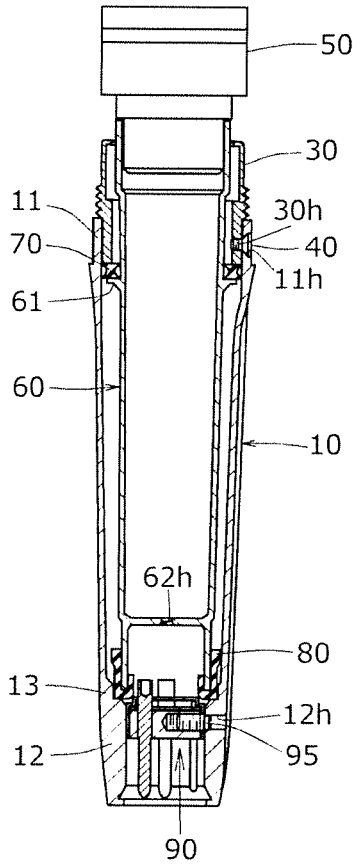
FIG. 8 is a cross-sectional view of the second assembly of the microphone in FIG. 7.

FIG. 8 is a cross-sectional view of the second assembly of the microphone 1.

First, the first assembly is assembled from the head-case attaching member 30, the internal cylinder 60, the first elastic member 70, and the second elastic member 80.

The first elastic member 70 is attached to the outer circumferential surface of the internal cylinder 60 from the front of the internal cylinder 60. The inner circumferential surfaces of skin layers 71 of the first elastic member 70 are in contact with the outer circumferential surface of the internal cylinder 60. A part of the rear end face 70*b* of the first elastic member 70 is in contact with the flange portion 61 of the internal cylinder 60. That is, the position of the first elastic member 70 relative to the internal cylinder 60 is determined by the flange portion 61. The second elastic member 80 is fit with the rear end of the internal cylinder 60.

The head-case attaching member 30 is attached to the internal cylinder 60 from the front of the internal cylinder 60. The rear end of the head-case attaching member 30 is in contact with a part of the front end face 70*a* of the first elastic member 70. A gap is formed between the inner circumferential surface of the head-case attaching member 30 and the outer circumferential surface of the internal cylinder 60.

Then, the unit 50 is attached to the internal cylinder 60. The rear portion of the unit 50 is fit in the opening of the front end of the internal cylinder 60. That is, the unit 50 is attached to the front end of the internal cylinder 60. The rear end of the unit 50, the internal cylinder 60, and the partition 62 of the internal cylinder 60 define the air chamber A of the unit 50 inside the internal cylinder 60.

Then, the first assembly and the output connector 90 are attached to the grip body 10 to assemble the second assembly.

The first assembly is inserted into the grip body 10 from the front of the grip body 10. The rear end of the second elastic member 80 is fit with a fitting portion 13 of the grip body 10. The screw 40 is inserted into the screw insertion hole 11*h* of the grip body 10. The screw 40 inserted into the screw insertion hole 11*h* is screwed into the internally threaded hole 30*h* of the head-case attaching member 30. That is, the first assembly is screwed to the grip body 10 with the screw 40.

Then, the output connector 90 is accommodated in the connector accommodating portion 12 from the rear of the grip body 10. The external screw 95 is preliminarily screwed into the internally threaded hole 91*a* of the base 91 of the output connector 90. The external screw 95 of the output connector 90 accommodated in the connector accommodating portion 12 is screwed out from the internally threaded hole 91*a* with a driver inserted into the tool insertion hole 12*h*, for example. The head of the external screw 95 is inserted into the tool insertion hole 12*h*. The shoulder portion of the external screw 95 is in contact with the inner circumferential surface of the connector accommodating portion 12. Thus, the base 91 is pressed by the external screw 95 in the direction opposite to the direction (the direction toward the right in FIG. 7) of the screwing out of the external screw 95. As a result, the shield cover 92 of the output connector 90 is pressed toward the inner circumferential surface of the grip body 10.

The unit 50 is preliminarily connected to the output connector 90 with the cable before the assembly of the first assembly. The cable is inserted through an insertion hole 62*h* of the partition 62 of the internal cylinder 60 and into the internal cylinder 60.

One end of the cable may be preliminarily connected to the unit 50 before the assembly of the second assembly, and the other end may be connected to the output connector 90 at the assembly of the second assembly.

Then, the name ring 100 and the head case 20 are attached to the second assembly.

Figure 9:
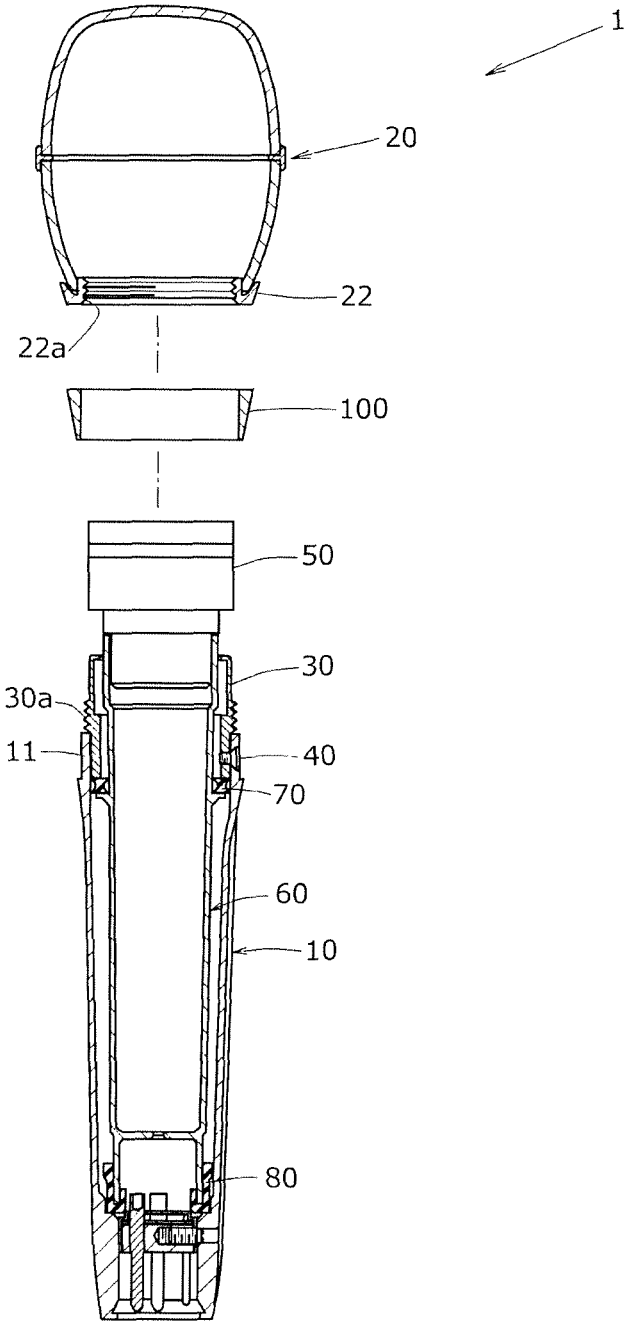
FIG. 9 is an exploded cross-sectional view illustrating the second assembly of the microphone in FIG. 7 and components to be attached to the second assembly.

FIG. 9 is an exploded cross-sectional view of the second assembly and the components attached to the second assembly of the microphone 1.

The name ring 100 is attached to the outer circumferential surface of the fixing portion 11 of the grip body 10 from the front of the second assembly. The screw 40 is shielded from the exterior by the name ring 100.

Then, the head case 20 is attached to the head-case attaching member 30 from the front of the second assembly. The externally threaded portion 30*a* of the head-case attaching member 30 is screwed into the internally threaded portion 22*a* of the fixing portion 22 of the head case 20. That is, the head case 20 is attached to the grip body 10 with the head-case attaching member 30. The unit 50 is disposed inside the head case 20.

The microphone 1 is assembled as described above into a finished product shown in FIG. 2. The internal cylinder 60 of the microphone 1 is disposed inside the grip body 10 with the first elastic member 70 and the second elastic member 80. That is, the internal cylinder 60 is supported inside the grip body 10 and isolated from vibration by the first elastic member 70 and the second elastic member 80.

Contact State of First Elastic Member and Other Components

The contact state of the first elastic member 70 and the other components of the microphone 1 will now be described.

Figure 10:
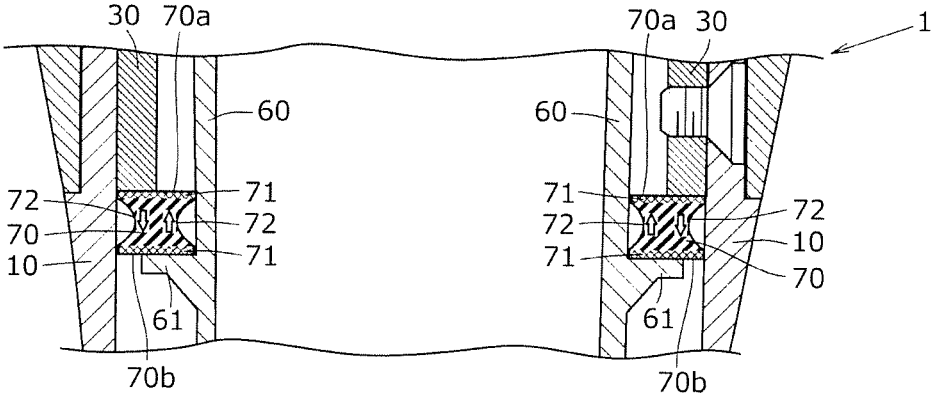
FIG. 10 is an enlarged cross-sectional view of main components of the microphone in FIG. 2.

FIG. 10 is an enlarged cross-sectional view of main components of the microphone 1. In FIG. 10, the shearing force (described below) received by the first elastic member 70 is illustrated by white arrows.

The outer circumferential surfaces of the skin layers 71 of the first elastic member 70 are in contact with the inner circumferential surface of the grip body 10. That is, the outer circumferential surface of the first elastic member 70 is in contact with the inner circumferential surface of the grip body 10 at only the skin layers 71 and portions adjacent to the skin layers 71 in the elastic portion. In other words, the first elastic member 70 is in contact with the grip body 10 in a small contact area. Thus, transmission of vibration from the grip body 10 to the first elastic member 70 is prevented in the microphone 1.

The inner circumferential surfaces of the skin layers 71 of the first elastic member 70 are in contact with the outer circumferential surface of the internal cylinder 60. That is, the inner circumferential surface of the first elastic member 70 is in contact with the outer circumferential surface of the internal cylinder 60 at only the skin layers 71 and portions adjacent to the skin layers 71 in the elastic portion. In other words, the first elastic member 70 is in contact with the internal cylinder 60 in a small contact area. Thus, transmission of vibration from the first elastic member 70 to the internal cylinder 60 is prevented in the microphone 1.

An outer circumferential portion of the front end face 70*a* of the first elastic member 70 is in contact with the rear end face of the head-case attaching member 30. That is, the head-case attaching member 30 is in contact with the outer circumferential portion of the first elastic member 70. An inner circumferential portion of the rear end face 70*b* of the first elastic member 70 is in contact with the flange portion 61 of the internal cylinder 60. That is, the flange portion 61 is in contact with the inner circumferential portion of the first elastic member 70. In other words, the first elastic member 70 is supported diagonally by the head-case attaching member 30 and the flange portion 61.

In this structure, the first elastic member 70 receives a shearing force in the front-back direction, when the force in the front-back direction (the vertical direction in FIG. 10) is applied to the first elastic member 70 by the head-case attaching member 30 and the flange portion 61. That is, the inner circumferential surface of the first elastic member 70 receives a shearing force in the direction (the direction toward the upper side in FIG. 10) toward the front where the unit 50 is disposed from the flange portion 61. On the other hand, the outer circumferential surface of the first elastic member 70 receives a shearing force in the direction (the direction toward the lower side in FIG. 10) toward the back from the head-case attaching member 30.

The first elastic member 70 also receives a compressing force in the front-back direction. As described above, the depressions 72 extend around the entire inner circumferential surface and the entire outer circumferential surface of the first elastic member 70. The first elastic member 70 is supported diagonally by the head-case attaching member 30 and the flange portion 61. Thus, a high shearing force is applied to the first elastic member 70 in the front-back direction. As a result, the first elastic member 70 undergoes shear deformation in the front-back direction. Accordingly, the first elastic member 70 undergoes shear deformation in the front-back direction, that is, in the longitudinal direction of the grip body 10, to support and isolate the internal cylinder 60 from vibration.

CONCLUSION

According to the embodiments described above, the internal cylinder 60 supporting the unit 50 is disposed inside the grip body 10 with the first elastic member 70 configured to undergo shear deformation in the front-back direction. Thus, the degree of contact between the first elastic member 70 and the internal cylinder 60 is substantially unvaried when the force is applied to the first elastic member 70 in the front-back direction. As a result, the microphone 1 does not generate noises or reduces the amount of noises caused by vibration from the grip body 10.

The depression 72 extends around the entire inner circumferential surface of the first elastic member 70. The contact area between the first elastic member 70 having the depression 72 and the internal cylinder 60 is smaller than the contact area between the elastic member and the internal cylinder of a conventional microphone in which the substantially entire inner circumferential surface of the elastic member is in contact with the outer circumferential surface of the internal cylinder. On the other hand, the depression 72 extends around the entire outer circumferential surface of the first elastic member 70. The contact area between the first elastic member 70 having the depression 72 and the grip body 10 is smaller than the contact area between the elastic body and the grip body of the conventional microphone. As a result, the first elastic member 70 readily undergoes shear deformation in the front-back direction, when the force is applied to the first elastic member 70 in the front-back direction. The elastic portion of the first elastic member 70 does not come into tight contact with the internal cylinder 60, when the force is applied to the first elastic member 70 in the front-back direction. As a result, the microphone 1 does not generate noises or reduces the amount of noises caused by vibration from the grip body 10, compared to the conventional microphone.

The first elastic member 70 is supported diagonally by the head-case attaching member 30 and the flange portion 61. Thus, the first elastic member 70 readily receives a shearing force in the front-back direction when the force is applied to the first elastic member 70 in the front-back direction. As a result, the microphone 1 does not generate noises or reduces the amount of noises caused by vibration from the grip body 10.

The first elastic member 70 has the skin layers 71 on the front end face 70*a* and the rear end face 70*b* of the first elastic member 70. The modulus of elasticity of the skin layers 71 is larger than the modulus of elasticity of the elastic portion. Thus, the skin layers 71 press diagonally the elastic portion without a significant deformation, when the force is applied to the first elastic member 70 in the front-back direction. As a result, the elastic portion readily undergoes shear deformation in the front-back direction. As a result, the microphone 1 does not generate noises or reduces the amount of noises caused by vibration from the grip body 10.

The invention claimed is:

1. A microphone comprising:

a grip body having a shape of a cylinder;

a head case attached to the grip body;

a microphone unit disposed inside the head case;

an internal cylinder to which the microphone unit is attached;

an elastic member configured to undergo shear deformation in a longitudinal direction of the grip body; and a head-case attaching member to which the head case is attached, wherein the internal cylinder is disposed inside the grip body with the elastic member, the head case is attached to the grip body with the head-case attaching member, the head-case attaching member has a rear end face, the internal cylinder has an outer circumferential surface, the elastic member has a top surface and a bottom surface, the head case is attached to the grip body with the head-case attaching member, the internal cylinder has a flange portion disposed on the outer circumferential surface of the internal cylinder, the head-case attaching member is in contact with a part of the top surface of the elastic member, the flange portion is in contact with a part of the bottom surface of the elastic member, the elastic member is supported diagonally by the head-case attaching member and the flange portion, the rear end face of the head-case attaching member is in contact with an outer circumferential portion of the top surface of the elastic member, the flange portion is in contact with an inner circumferential portion of the bottom surface of the elastic member, the elastic member has a shape of a ring, the elastic member having an inner circumferential surface and an outer circumferential surface, the elastic member is attached to the outer circumferential surface of the internal cylinder, and the elastic member has a depression in at least one of the outer circumferential surface of the elastic member and the inner circumferential surface of the elastic member, wherein the depression is disposed on an entire circumference of the elastic member.

2. The microphone according to claim 1, wherein the inner circumferential surface of the elastic member receives a shearing force in a direction toward the microphone unit, and the outer circumferential surface of the elastic member receives a shearing force in a direction opposite to the direction toward the microphone unit.

3. A microphone comprising:

a grip body having a shape of a cylinder;

a head case attached to the grip body;

a microphone unit disposed inside the head case;

an internal cylinder to which the microphone unit is attached;

an elastic member configured to undergo shear deformation in a longitudinal direction of the grip body; and a head-case attaching member to which the head case is attached, wherein the internal cylinder is disposed inside the grip body with the elastic member, the head case is attached to the grip body with the head-case attaching member, the head-case attaching member has a rear end face, the internal cylinder has an outer circumferential surface, the elastic member has a top surface and a bottom surface, the head case is attached to the grip body with the head-case attaching member, the internal cylinder has a flange portion disposed on the outer circumferential surface of the internal cylinder, the head-case attaching member is in contact with a part of the top surface of the elastic member, the flange portion is in contact with a part of the bottom surface of the elastic member, the elastic member is supported diagonally by the head-case attaching member and the flange portion, the rear end face of the head-case attaching member is in contact with an outer circumferential portion of the top surface of the elastic member, the flange portion is in contact with an inner circumferential portion of the bottom surface of the elastic member, wherein the elastic member has a skin layer on at least one of the top surface of the elastic member and the bottom surface of the elastic member, the skin layer is formed from a part of the elastic member, and the skin layer has a modulus of elasticity which is larger than a modulus of elasticity of a portion other than the skin layer of the elastic member.

4. The microphone according to claim 3, wherein the skin layer is a component separate from the elastic member, and the skin layer has a modulus of elasticity which is larger than a modulus of elasticity of the elastic member.

5. The microphone according to claim 3, wherein the grip body has an inner circumferential surface, the elastic member has the skin layer on the top surface of the elastic member, and the outer circumferential surface of the elastic member is in contact with the inner circumferential surface of the grip body at the skin layer and a portion other than the skin layer of the elastic member, which is adjacent to the skin layer.

6. The microphone according to claim 3, wherein the elastic member has the skin layer on the bottom surface of the elastic member, and the inner circumferential surface of the elastic member is in contact with the outer circumferential surface of the internal cylinder at the skin layer and a portion other than the skin layer of the elastic member, which is adjacent to the skin layer.

* * * * *